US009676205B2

(12) United States Patent
Moto et al.

(10) Patent No.: US 9,676,205 B2
(45) Date of Patent: Jun. 13, 2017

(54) THERMAL HEAD AND THERMAL PRINTER

(71) Applicant: KYOCERA Corporation, Kyoto-shi, Kyoto (JP)

(72) Inventors: Youichi Moto, Kyoto (JP); Takashi Asou, Kyoto (JP); Shigetaka Shintani, Kyoto (JP); Masashi Yoneta, Kyoto (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 15/107,635

(22) PCT Filed: Dec. 26, 2014

(86) PCT No.: PCT/JP2014/084605

§ 371 (c)(1),
(2) Date: Jun. 23, 2016

(87) PCT Pub. No.: WO2015/099149

PCT Pub. Date: Jul. 2, 2015

(65) Prior Publication Data

US 2016/0318309 A1 Nov. 3, 2016

(30) Foreign Application Priority Data

Dec. 26, 2013 (JP) ..... 2013-269425

(51) Int. Cl.
*B41J 2/335* (2006.01)

(52) U.S. Cl.
CPC ..... *B41J 2/3351* (2013.01); *B41J 2/3353* (2013.01); *B41J 2/3354* (2013.01); *B41J 2/3357* (2013.01);
(Continued)

(58) Field of Classification Search
CPC .... B41J 2/335; B41J 2/33505; B41J 2/33595; B41J 2/345; B41J 2/3351; B41J 2/33515;
(Continued)

(56) References Cited

U.S. PATENT DOCUMENTS

2014/0333708 A1 11/2014 Ochi et al.
2015/0009270 A1 1/2015 Hirose et al.

FOREIGN PATENT DOCUMENTS

JP 11-179948 A 7/1999
JP 2005-138484 A 6/2005
(Continued)

OTHER PUBLICATIONS

International Search Report, PCT/JP2014/084605, Mar. 31, 2015, 2 pgs.

*Primary Examiner* — Kristal Feggins
(74) *Attorney, Agent, or Firm* — Volpe and Koenig, P.C.

(57) ABSTRACT

A thermal head includes: a substrate; a thermal storage layer disposed on the substrate and having a ridge portion; heat generating portions disposed on the ridge portion; and electrodes which are disposed on the substrate. At least one of the electrodes has a first corner portion at which a side surface and an upper surface intersect, more upstream in the conveyance direction of the recording medium than the top portion of the ridge portion. In a cross section of the thermal head, an inclination angle of an imaginary line which connects an intersection point of an imaginary line which hangs downward from the top portion (**13*b*1**) of the ridge portion and the substrate, with the first corner portion, is 75° or less from the substrate. Thus, printing residue is less likely to adhere to the thermal head.

17 Claims, 10 Drawing Sheets

(52) U.S. Cl.
CPC ..... *B41J 2/33515* (2013.01); *B41J 2/33525* (2013.01); *B41J 2/33535* (2013.01)

(58) Field of Classification Search
CPC .. B41J 2/3353; B41J 2/33535; B41J 2/33565; B41J 2/3357; B41J 2/33555
See application file for complete search history.

(56) References Cited

FOREIGN PATENT DOCUMENTS

| | | | |
|---|---|---|---|
| JP | 2006-305974 | A | 11/2006 |
| JP | 2007-175982 | A | 7/2007 |
| WO | 2013/080915 | A1 | 6/2013 |
| WO | 2013/129020 | A1 | 9/2013 |

THERMAL HEAD AND THERMAL PRINTER

TECHNICAL FIELD

The present invention relates to a thermal head and a thermal printer.

BACKGROUND ART

Various thermal heads are suggested as a photographic printing device such as a facsimile or a video printer. For example, a thermal head is known that includes a substrate, a thermal storage layer disposed on the substrate, the thermal storage layer having a ridge portion which protrudes upward from the substrate, a plurality of heat generating portions disposed on the ridge portion, and a plurality of electrodes which are disposed on the substrate and electrically connected to the plurality of heat generating portions (refer to Patent Literature 1). Then, the electrode has an upper surface, a side surface facing a conveyance direction of a recording medium, and a first corner portion at which the side surface and an upper surface intersect.

In recent years, a thermal head has been suggested in which the plurality of heat generating portions are disposed more downstream in the conveyance direction of the recording medium than a top portion of the ridge portion, and thereby, it is possible to enhance image quality and speed up the thermal head.

CITATION LIST

Patent Literature

Patent Literature 1: Japanese Unexamined Patent Publication JP-A 2005-138484

SUMMARY OF INVENTION

Technical Problem

However, when the plurality of heat generating portions are disposed more downstream in the conveyance direction of the recording medium than the top portion of the ridge portion, the first corner portion is formed on the top portion of the ridge portion. There is a possibility that the top portion of the ridge portion is subject to maximum pressing force from a platen roller and printing residue which is separated from the recording medium on the first corner portion adheres thereto.

Solution to Problem

A thermal head according to an embodiment of the invention includes a substrate; a thermal storage layer disposed on the substrate, the thermal storage layer having a ridge portion which protrudes upward from the substrate; a plurality of heat generating portions disposed on the ridge portion; and a plurality of electrodes which are disposed on the substrate and electrically connected to the plurality of heat generating portions. The plurality of heat generating portions are disposed more downstream in a conveyance direction of a recording medium than a top portion of the ridge portion. At least one of the electrodes has an upper surface, a side surface facing the conveyance direction of the recording medium, and a first corner portion at which the side surface and an upper surface intersect, more upstream in the conveyance direction of the recording medium than the top portion of the ridge portion. In a cross section of the thermal head, an inclination angle of an imaginary line which connects an intersection point of an imaginary line which hangs downward from the top portion of the ridge portion and the substrate, with the first corner portion, is 75° or less from the substrate.

In addition, a thermal printer according to another embodiment of the invention comprises the thermal head described above, a conveying mechanism which conveys the recording medium on the plurality of heat generating portions, and a platen roller which presses the recording medium against the plurality of heat generating portions.

Advantageous Effects of Invention

According to the invention, it is possible to reduce a possibility that printing residue adheres to the thermal head.

DESCRIPTION OF EMBODIMENTS

First Embodiment

Figure 1:
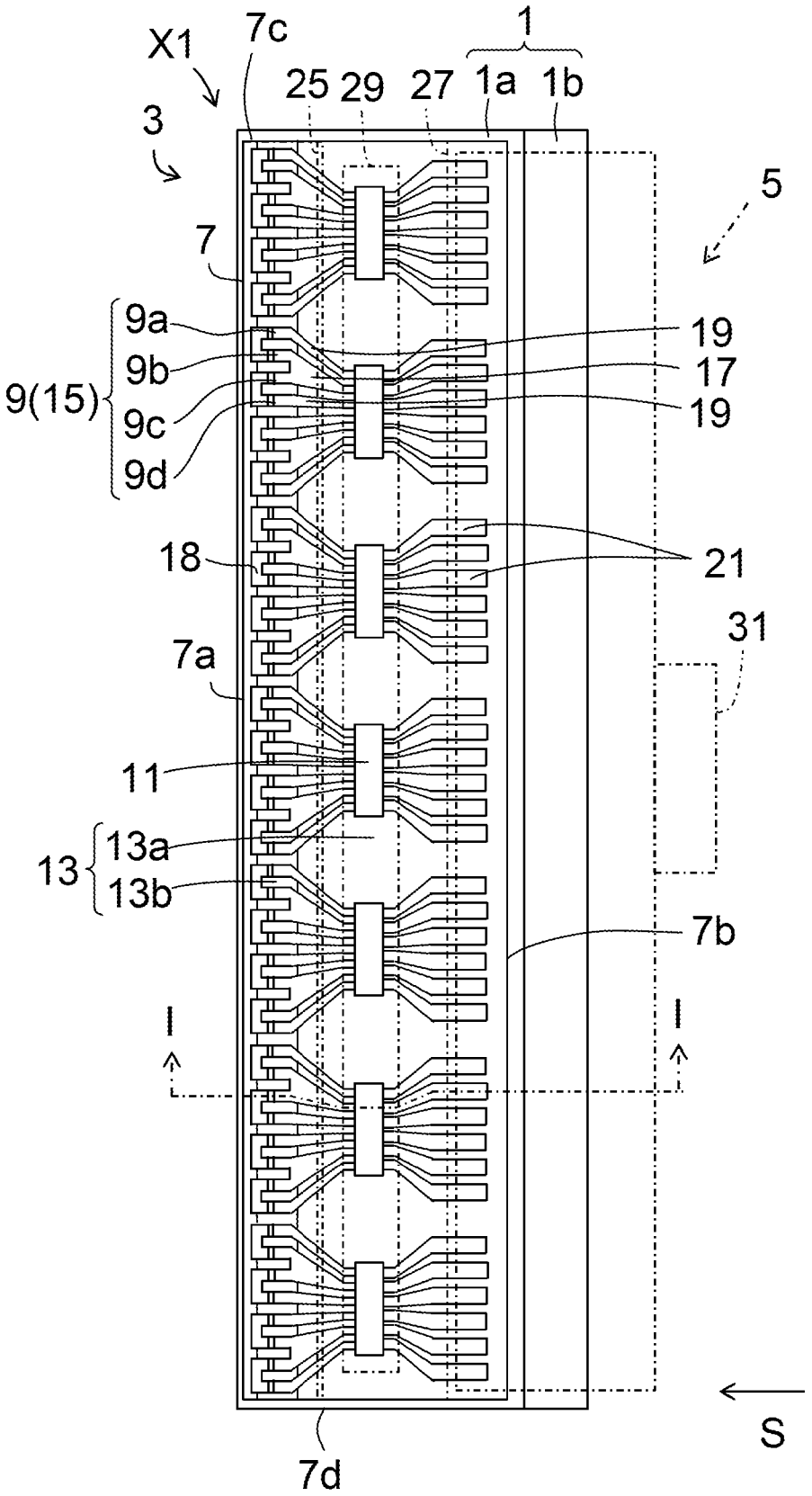
FIG. 1 is a plan view illustrating a thermal head according to a first embodiment of the invention.

A thermal head X1 is described below with reference to FIGS. 1 to 5. Note that, in FIG. 1, a region in which an FPC 5 is disposed is indicated by a dashed-dotted line. In addition, in FIG. 1, a region in which a protection layer 25, a covering layer 27, and a covering member 29 are disposed is indicated by a dashed-dotted line. Note that, in FIG. 3, a top portion 13*b*1 and edge portions 13*b*2 and 13*b*3 of a ridge portion 13*b* are indicated by a dashed-dotted line, and are the same in FIGS. 7 and 8.

The thermal head X1 includes a heat dissipation body 1, a head base 3 which is disposed on the heat dissipation body 1, and a flexible printed circuit board 5 (hereinafter referred to as FPC 5) which is connected to the head base 3.

The heat dissipation body 1 is formed in a plate shape, and is formed in an elongated shape when viewed in a plan view. The heat dissipation body 1 has a base portion 1*a* with a plate shape and a projecting portion 1*b* which protrudes from the base portion 1*a*. For example, the heat dissipation body 1 is formed of a metal material such as copper, iron, or aluminum, and has a function of dissipating heat which does not contribute to photographic printing out of the heat which is generated by a heat generating portion 9 of the head base 3. In addition, the head base 3 is adhered by a double-sided tape, adhesive, or the like (not illustrated) on an upper surface of the base portion 1*a*.

The head base 3 is formed in a plate shape in a plan view, and members constituting the thermal head X1 are disposed on a substrate 7 of the head base 3. The head base 3 has a function of performing printing on the recording medium (not illustrated) in accordance with an electrical signal which is supplied from the outside.

The FPC 5 is electrically connected to the head base 3, and is a circuit board which has a function of supplying current and the electrical signal to the head base 3. The FPC 5 is provided with a plurality of patterned printed wirings (not illustrated) inside an insulating resin layer, one end portion of the printed wiring is exposed from the resin layer, and the other end portion thereof is electrically connected to a connector 31.

The printed wiring is connected to a connection electrode 21 of the head base 3 via a joining material 23. Thereby, the head base 3 and the FPC 5 are electrically connected. The joining material 23 is able to be exemplified by a solder material or an anisotropically-conductive film (ACF) in which conductive particles are mixed within an electrically insulating resin.

Note that, although an example is indicated in which the FPC 5 is used as the circuit board, a rigid circuit board may be used in lieu of an FPC 5 with flexibility. As a rigid printed circuit board, it is possible to exemplify a board which is formed by a resin such as a glass epoxy board or a polyimide board. In addition, the head base 3 and the outside may be electrically connected by directly joining a connector 31 to the head base 3.

Members constituting the head base 3 are described below. The substrate 7 is a rectangular shape in a plan view, and has one long side 7*a*, the other long side 7*b*, one short side 7*c*, and the other short side 7*d*. The substrate 7 is formed of an electrical insulating material such as alumina ceramics, a semiconductor material such as monocrystalline silicon, or the like.

A thermal storage layer 13 is formed on an upper surface of the substrate 7. The thermal storage layer 13 includes an underlayer portion 13*a* and the ridge portion 13*b*. The underlayer portion 13*a* is formed across a whole region of the upper surface of the substrate 7. The ridge portion 13*b* extends in a band along a disposal direction (hereinafter referred to as a main scanning direction) of the plurality of heat generating portions 9, and a cross section is a substantially semi-elliptical shape.

The ridge portion 13*b* functions to press a photographic printing recording medium favorably against the protection layer 25 which is formed on the heat generating portion 9. The ridge portion 13*b* includes the top portion 13*b*1, the edge portion 13*b*2, and the edge portion 13*b*3.

The thermal storage layer 13 is formed of glass with low thermal conductivity, and is able to shorten time necessary to raise temperature of the heat generating portion 9, by temporarily storing part of heat generated by the heat generating portion 9. Thereby, it is possible to improve thermal response characteristics of a thermal head X1. For example, the thermal storage layer 13 is formed by mixing an appropriate organic solvent with glass powder and applying a predetermined glass paste which is obtained by the mixing to the upper surface of the substrate 7 using well-known screen printing and the like, and firing the glass paste.

An electrical resistance layer 15 is disposed on an upper surface of the thermal storage layer 13, and a common electrode 17, a folded electrode 18, an individual electrode 19, and a connection electrode 21 are provided on the electrical resistance layer 15. The electrical resistance layer 15 is patterned in the same shape as the common electrode 17, the folded electrode 18, the individual electrode 19, and the connection electrode 21, and has an exposed region in which the electrical resistance layer 15 between the folded electrode 18 and the common electrode 17 or the individual electrode 19 is exposed.

As shown in FIG. 1, the exposed region of the electrical resistance layer 15 is disposed in a row on the ridge portion 13*b* of the thermal storage layer 13, and each exposed region constitutes the heat generating portion 9. The heat generating portion 9 has a first heat generating portion 9*a*, a second heat generating portion 9*b*, a third heat generating portion 9*c*, and a fourth heat generating portion 9*d*. For convenience of description, the plurality of heat generating portions 9 are simply described in FIG. 1, but for example, are disposed at a density of 100 dpi (dots per inch) to 2400 dpi and the like.

For example, the electrical resistance layer 15 is formed by a TaN-based, TaSiO-based, TaSiNO-based, TiSiO-based, TiSiCO-based, or NbSiO-based relatively high electrical resistance material. Accordingly, when voltage is applied to the heat generating portion 9, the heat generating portion 9 generates heat using Joule heat generation.

Figure 2:
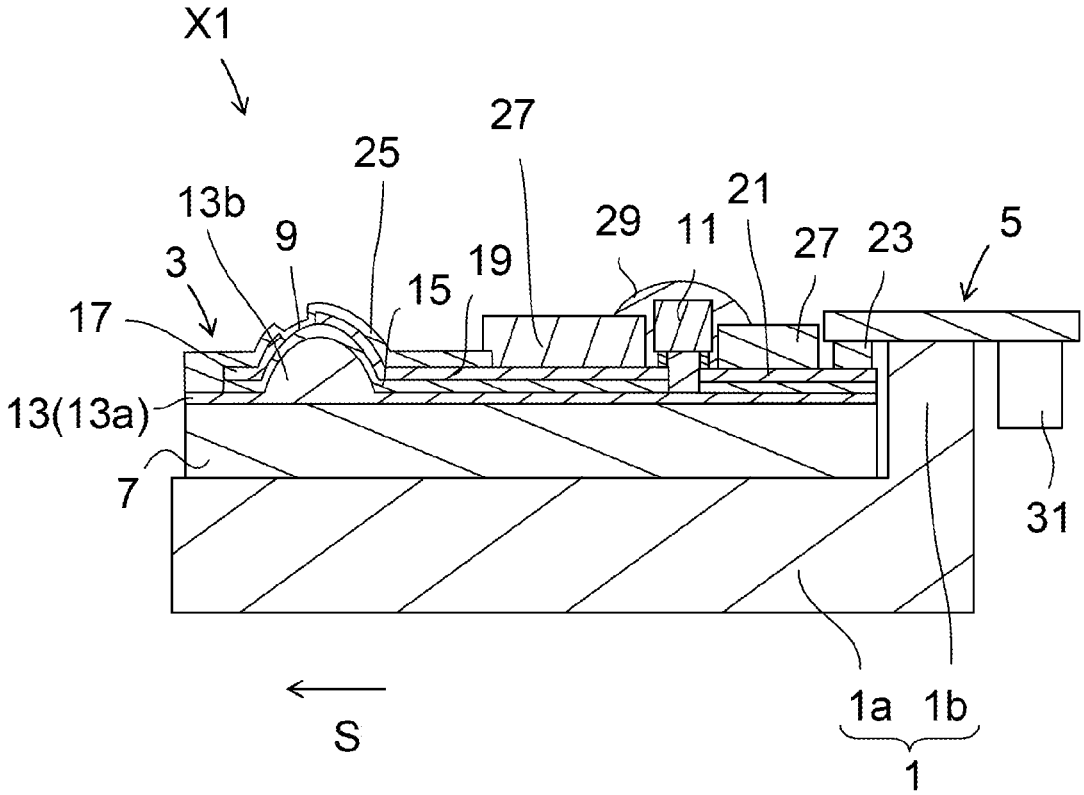
FIG. 2 is a sectional view taken along the line I-I shown in FIG. 1.

As shown in FIGS. 1 and 2, a plurality of common electrodes 17, a plurality of folded electrodes 18, a plurality of individual electrodes 19, and a plurality of connection electrodes 21 are disposed on an upper surface of the electrical resistance layer 15. The common electrodes 17, the individual electrodes 19, and the connection electrodes 21 are formed of a material having conductivity, and for example, are formed of any type of metal of aluminum, gold, silver, and copper, or an alloy thereof.

The common electrode 17 is connected to the FPC 5, the second heat generating portion 9*b*, and the third heat generating portion 9*c*. Accordingly, the second heat generating portion 9*b* and the FPC 5 are connected by the common electrode 17, and the third heat generating portion 9*c* and the FPC 5 are connected by the common electrode 17.

The common electrode 17 has a narrow portion 6, and a first corner portion 8 is formed by the narrow portion 6. The narrow portion 6 is configured so that a width thereof is smaller than a length of a total of a width of a connecting portion 17*a* connected to the second heat generating portion 9*b* and a width of the connecting portion 17*a* connected to the third heat generating portion 9*c*. In addition, the common electrode 17 is branched into two by a branching portion, is connected to the second heat generating portion 9*b* by the connecting portion 17*a* of one branched common electrode 17, and is connected to the third heat generating portion 9*c* by the connecting portion 17*a* of the other branched common electrode 17. Then, a third corner portion 14 is formed by the branching portion of the common electrode 17.

The folded electrode 18 has a first folded electrode 18*a* and a second folded electrode 18*b*. The folded electrode 18 electrically connects adjacent heat generating portions 9. The first folded electrode 18*a* has a first connecting portion 18*a*1 and a second connecting portion 18*a*2, in the first connecting portion 18*a*1, one end portion thereof is connected to the first heat generating portion 9*a*, and in the second connecting portion 18*a*2, the other end portion thereof is connected to the second heat generating portion 9*b*. The second folded electrode 18*b* has a first connecting portion 18*b*1 and a second connecting portion 18*b*2, in the first connecting portion 18*b*1, one end portion thereof is connected to the third heat generating portion 9*c*, and in the second connecting portion 18*b*2, the other end portion thereof is connected to the fourth heat generating portion 9*d*. The first folded electrode 18*a* is formed in a C shape in a plan view. Then, a side wall which connects the first connecting portion 18*a*1 and the second connecting portion 18*a*2 of the first folded electrode 18*a* forms a fourth corner portion 16. This also applies to the second folded electrode 18*b*.

The individual electrode 19 has a first individual electrode 19*a* and a second individual electrode 19*b*. The individual electrode 19 electrically connects each heat generating portion 9 and a driving IC 11 so that one end portion thereof is connected to the heat generating portion 9 and the other end portion thereof is connected to the driving IC 11. The first individual electrode 19*a* is connected to the first heat generating portion 9*a*, and the second individual electrode 19*b* is connected to the fourth heat generating portion 9*d*. The individual electrode 19 has a wide portion 4, and a second corner portion 10 is formed by the wide portion 4.

The plurality of connection electrodes 21 electrically connects the driving IC 11 and the FPC 5 so that one end portion thereof is connected to the driving IC 11 and the other end portion thereof is connected to the FPC 5. The plurality of connection electrodes 21 which are connected to the corresponding driving IC 11 are configured by a plurality of wirings which have different functions.

As shown in FIG. 1, the driving IC 11 is disposed corresponding to each group composed of several heat generating portions 9, and is connected to the individual electrodes 19 and the connection electrodes 21. The driving IC 11 has a function of controlling a power supply state of each heat generating portion 9. A switching member which has a plurality of switching elements therein may be used as the driving IC 11.

For example, the electrical resistance layer 15, the common electrode 17, the folded electrode 18, the individual electrode 19, and the connection electrode 21, are formed by sequentially laminating a material layer configuring each of them on the thermal storage layer 13 by a well-known thin film forming technique such as a sputtering method, and by processing a laminated body in a predetermined pattern using well-known photo etching and the like. Note that, the common electrode 17, the folded electrode 18, the individual electrode 19, and the connection electrode 21 are able to be simultaneously formed by the same process.

The protection layer 25 is disposed from an end to the other end of the thermal storage layer 13 in a main scanning direction on the thermal storage layer 13 which is formed on the upper surface of the substrate 7, and the protection layer 25 is formed so as to cover from one long side 7*a* of the substrate 7, through the heat generating portion 9, the common electrode 17, and the folded electrode 18, to a portion of the individual electrode 19.

The protection layer 25 is configured to protect a region which covers the heat generating portion 9, the common electrode 17, the folded electrode 18, and the individual electrode 19 from corrosion by adhesion of moisture or the like which is included in the atmosphere or wear due to contact with the photographic printing recording medium. It is possible to form the protection layer 25 using SiN, SiO, SiON, SiC, diamond-like carbon, or the like, the protection layer 25 may be configured by a single layer, and may be configured by laminating the layers. Such a protection layer 25 is able to be manufactured using a thin-film formation technique such as sputtering or a thick film formation technique such as screen printing.

In addition, the covering layer 27 which partially covers the common electrode 17, the individual electrode 19, and the connection electrode 21 is disposed on the underlayer portion 13*a* of the thermal storage layer 13 that is formed on the upper surface of the substrate 7. Note that, in FIG. 1, for convenience of description, a formation region of the covering layer 27 is indicated by a dashed-dotted line. The covering layer 27 is not disposed at a position at which the driving IC 11 is mounted, and is provided with an opening at the position at which the driving IC 11 is mounted.

The protection layer 27 is configured to protect a region which covers the common electrode 17, the individual electrode 19, and the connection electrode 21 from oxidation due to coming into contact with the atmosphere and corrosion by adhesion of moisture or the like which is included in the atmosphere. In order to more reliably protect the common electrode 17 and the individual electrode 19, as shown in FIG. 2, the covering layer is formed so as to overlap with an end portion of the protection layer 25. For example, it is possible to form the covering layer 27 of a resin material such as an epoxy resin, a polyimide resin, or the like using a thick film formation technique such as a screen printing method.

The covering member 29 is disposed for covering and sealing the plurality of driving ICs 11, and functions to protect the driving IC 11 and protect the connecting portion of the driving IC 11, the common electrode 17, and the individual electrode 19. The covering member 29 is disposed in a band form in the longitudinal direction of the substrate 7 so as to coat the plurality of driving ICs 11 all together in the opening portion of the covering layer 27. As the covering member 29, it is possible to exemplify the covering member 29 made of resin such as epoxy resin or silicone resin.

Figure 3:
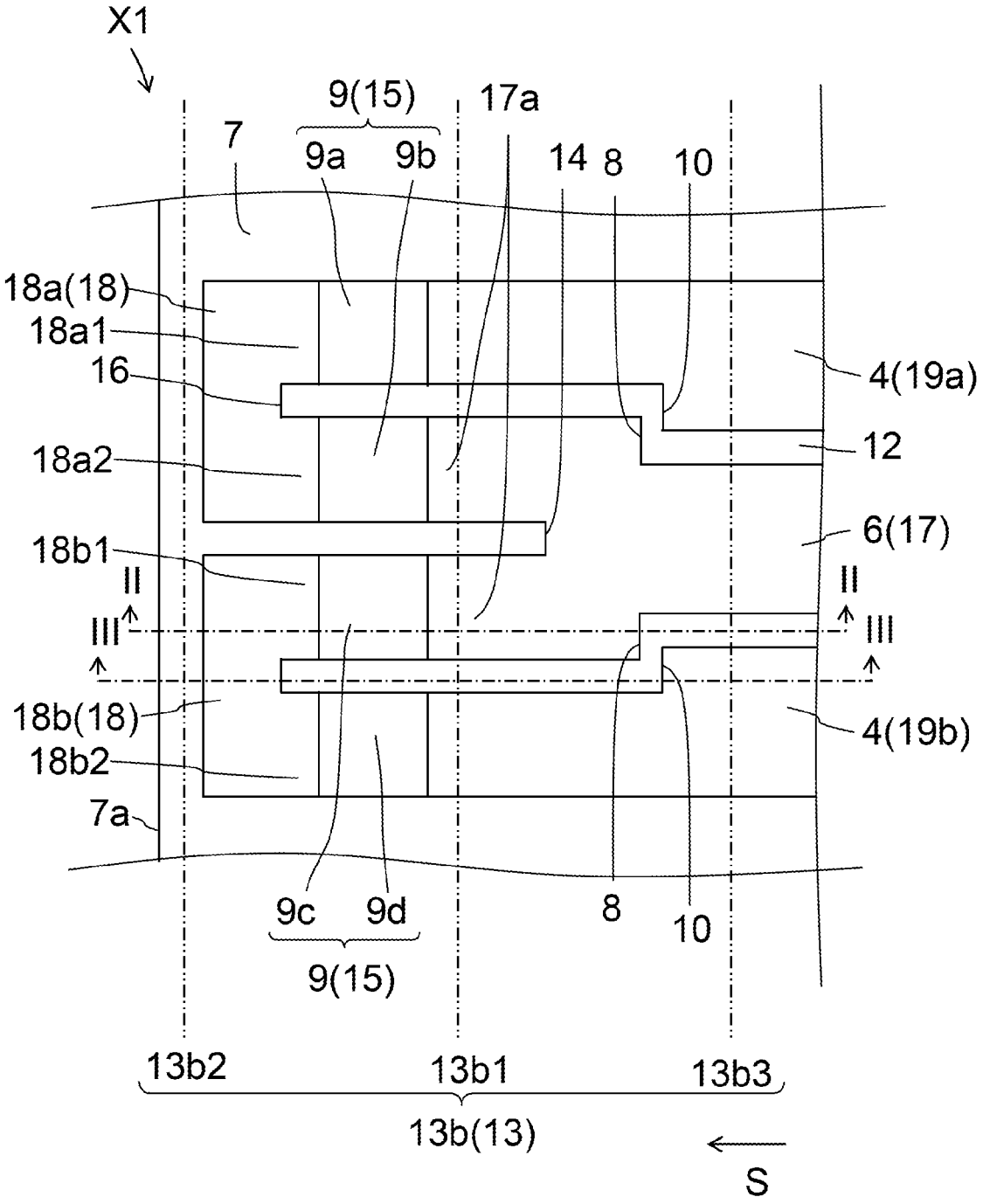
FIG. 3 is an enlarged plan view illustrating a vicinity of a heat generating portion of the thermal head shown in FIG. 1.
Figure 4:
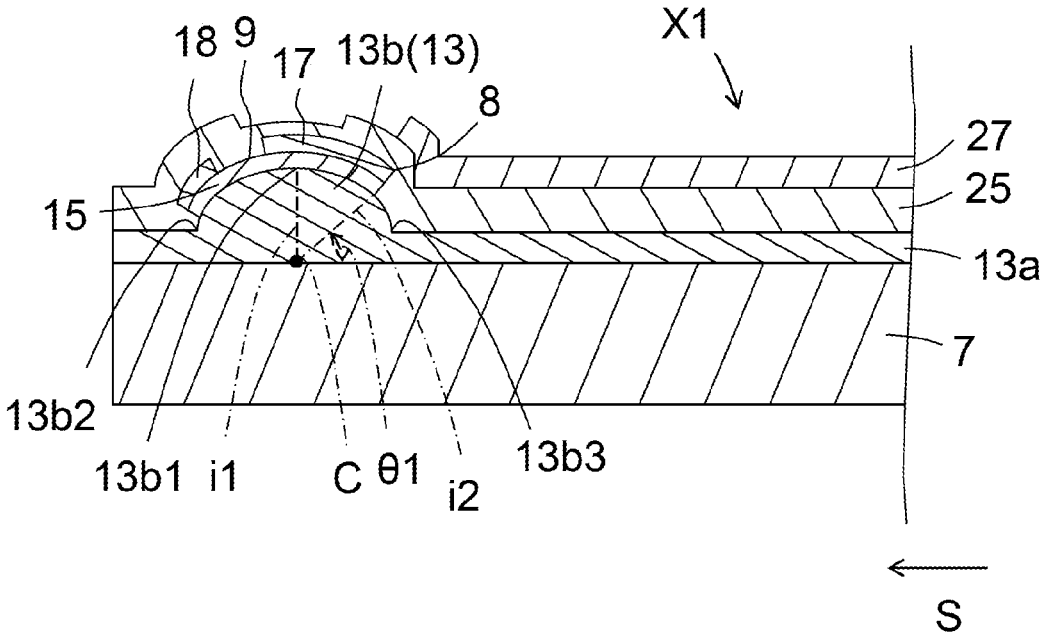
FIG. 4 is a sectional view taken along the line II-II shown in FIG. 3.
Figure 5:
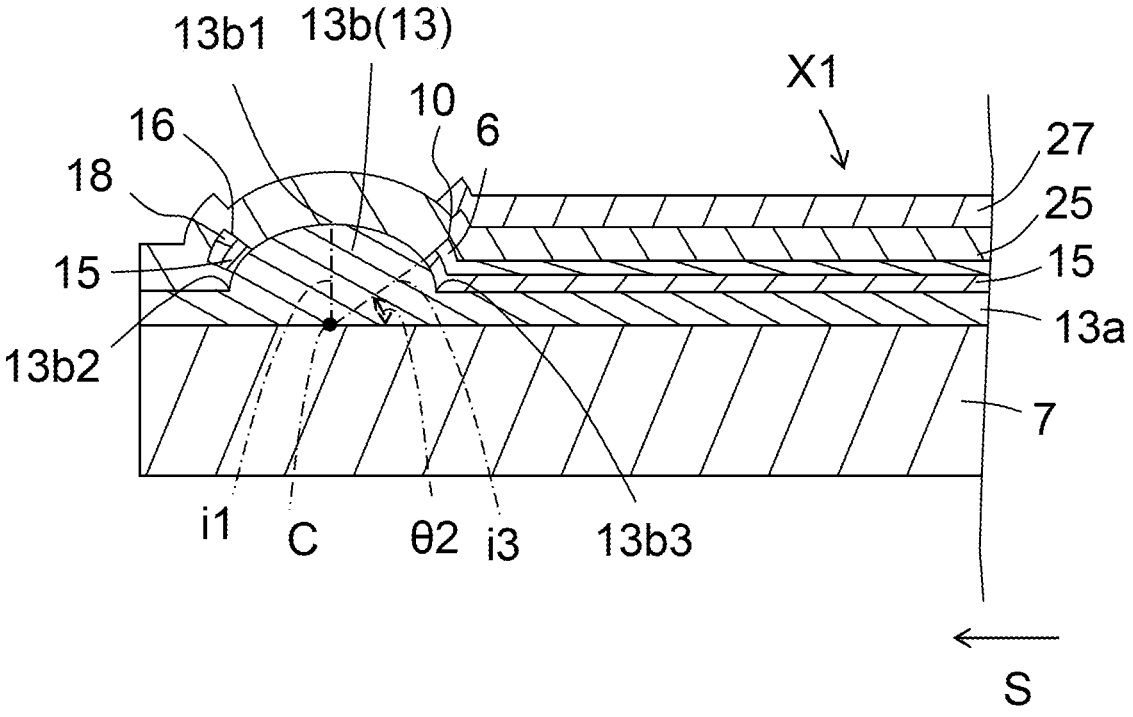
FIG. 5 is a sectional view taken along the line III-III shown in FIG. 3.

The common electrode 17, the folded electrode 18, and the individual electrode 19 are described in detail using FIGS. 3 to 5. Note that, in FIG. 3, illustration of the protection layer 25 and the covering layer 27 is omitted.

The thermal head 3*b*3 includes the first heat generating portion 9*a*, the second heat generating portion 9*b*, the third heat generating portion 9*c*, and the fourth heat generating portion 9*d* in the main scanning direction. The first heat generating portion 9*a*, the second heat generating portion 9*b*, the third heat generating portion 9*c*, and the fourth heat generating portion 9*d* are disposed on the thermal storage layer 13, and are disposed more downstream in a conveyance direction S of the recording medium (hereinafter may be referred to as conveyance direction S) than the top portion 13*b*1 of the ridge portion 13*b* of the thermal storage layer 13.

The electrodes constituting the thermal head 3*b*3 has the first folded electrode 18*a*, the second folded electrode 18*b*, the first individual electrode 19*a*, the second individual electrode 19*b*, the common electrode 17, and the connection electrode (not illustrated).

One side of the first heat generating portion 9*a* is connected to the first folded electrode 18*a* and the other side thereof is connected to the first individual electrode 19*a*. One side of the second heat generating portion 9*b* is connected to the first folded electrode 18*a* and the other side thereof is connected to the common electrode 17. One side of the third heat generating portion 9*c* is connected by the second folded electrode 18*b* and the other side thereof is connected to the common electrode 17. One side of the fourth heat generating portion 9*d* is connected to the second folded electrode 18*b* and the other side thereof is connected to the second individual electrode 19*b*. Electrodes adjacent to each other are separated by a gap 12.

Accordingly, the first heat generating portion 9*a* and the second heat generating portion 9*b* are electrically connected in series, the third heat generating portion 9*c* and the fourth heat generating portion 9*d* are electrically connected in series, and the first heat generating portion 9*a* and the third heat generating portion 9*c* are electrically connected in parallel.

The first individual electrode 19*a*, the common electrode 17, and the second individual electrode 19*b* are connected to the heat generating portion 9 at substantially equal width. Thereby, the amount of heat which is released from the heat generating portion 9 is made close to uniform to the respective electrodes.

The common electrode 17 has a connecting portion 17*a* which is connected to the second heat generating portion 9*b*, and a connecting portion 17*a* which is connected to the third heat generating portion 9*c*, and these connecting portions 17*a* are integrally connected by the narrow portion 6. In addition, the common electrode 17 forms the first corner portion 8 and the third corner portion 14.

The narrow portion 6 is formed so as to be shorter than a length of a total of a width of the connecting portion 17*a* connected to the second heat generating portion 9*b* and a width of the connecting portion 17*a* connected to the third heat generating portion 9*c*. Thereby, the width of the narrow portion 6 of the common electrode 17, the width of the wide portion 4 of the first individual electrode 19*a*, and the width of the wide portion 4 of the second individual electrode 19*b* are substantially the same length. Thereby, it is possible to make a contact state of the recording medium and the thermal head X1 close to uniform in the main scanning direction.

The first individual electrode 19*a* and the second individual electrode 19*b* have the wide portion 4 which protrudes toward the adjacent common electrode 17. Accordingly, the first individual electrode 19*a* and the second individual electrode 19*b* are configured so that the width in the wide portion 4 is wide. In addition, the first individual electrode 19*a* and the second individual electrode 19*b* each form the second corner portion 10.

The first folded electrode 18*a* has the first connecting portion 18*a*1 which is connected to the first heat generating portion 9*a*, and the second connecting portion 18*a*2 which is connected to the second heat generating portion 9*b*. In addition, the second folded electrode 18*b* has the first connecting portion 18*b*1 which is connected to the third heat generating portion 9*c*, and the second connecting portion 18*b*2 which is connected to the fourth heat generating portion 9*d*. In addition, the folded electrode 18 forms the fourth corner portion 16.

The first corner portion 8 is formed so that an upper surface of the connecting portion 17*a* which is connected to the second heat generating portion 9*b* and a side surface thereof facing the conveyance direction S intersect. In addition, the first corner portion 8 is formed so that an upper surface of the connecting portion 17*a* which is connected to the third heat generating portion 9*c* and a side surface thereof facing the conveyance direction S intersect. For this reason, in the gap 12, viewed from the right side of FIG. 3 which is the upstream side in the conveyance direction S, the first corner portion 8 protrudes upward by the thickness of the connecting portion 17*a* of the common electrode 17, and the side surface facing the conveyance direction S, the upper surface, and the thermal storage layer 13 define a stepped portion.

The first corner portion 8 is disposed more upstream in the conveyance direction S than the heat generating portion 9 and the top portion 13*b*1. As shown in FIG. 4, the thermal head X1 has an intersection point C of an imaginary line i1 which hangs downward from the top portion 13*b*1 of the ridge portion 13*b* and the substrate 7. The first corner portion 8 is disposed at a position where an inclination angle θ1, from the substrate 7, of an imaginary line i2 which connects the intersection point C and the first corner portion 8 is 75° or less. Thereby, the first corner portion 8 is formed on an edge portion 13*b*3 side of the ridge portion 13*b*. Accordingly, the first corner portion 8 is formed at a lower position than the top portion 13*b*1.

The second corner portion 10 is formed so that an upper surface and a side surface of the wide portion 4 intersect. Accordingly, viewed from the right side of FIG. 3 which is the upstream side in the conveyance direction S, the second corner portion 10 is lowered downward by the thickness of the first individual electrode 19*a* or the second individual electrode 19*b*, and the side surface, the upper surface, and the thermal storage layer 13 define a stepped portion.

The third corner portion 14 is formed by a part of which is branched into the connecting portion 17*a* which is connected to the second heat generating portion 9*b* of the common electrode 17 and the connecting portion 17*a* which is connected to the third heat generating portion 9*c* of the common electrode 17, and is formed so that the upper surface and side surface of the branched part intersect. Accordingly, viewed from the right side of FIG. 3 which is the upstream side in the conveyance direction S, the third corner portion 14 is lowered downward by the thickness of the connecting portion 17*a*, and the side surface facing the conveyance direction S, the upper surface, and the thermal storage layer 13 define a stepped portion.

The fourth corner portion 16 is formed by a part which connects the first connecting portion 18*a*1 and the second connecting portion 18*a*2 of the first folded electrode 18*a*, and is formed so that the upper surface of the part which connects the first connecting portion 18*a*1 and the second connecting portion 18*a*2 and the side surface facing the conveyance direction S intersect. Accordingly, viewed from the right side of FIG. 3 which is the upstream side in the conveyance direction S, the fourth corner portion 14 protrudes upward by the thickness of the first folded electrode 18*a*, and the side surface facing the conveyance direction S, the upper surface, and the thermal storage layer 13 define a stepped portion.

Here, the first corner portion 8 is disposed at the gap 12 on the downstream side in the conveyance direction S and protrudes upward. Accordingly, in a case where printing residue such as an ink ribbon residue or a paper residue is generated due to conveyance of the recording medium, when printing residue is conveyed along with the recording medium, there is a possibility that printing residue or the like is accumulated at the first corner portion 8.

In contrast to this, the first corner portion 8 is disposed at a position where an inclination angle θ1 is 75° or less from the substrate 7. Accordingly, the first corner portion 8 is disposed at the edge portion 13*b*3 side of the ridge portion 13*b*, and the first corner portion 8 is disposed at a position at a lower height from the substrate 7 than the top portion 13*b*1. Accordingly, even in a case where printing residue is conveyed along with the recording medium, it is possible to reduce the possibility that printing residue is accumulated at the first corner portion 8.

Pressing force of the platen roller (not illustrated) against the ridge portion 13*b* is the largest at the top portion 13*b*1, and becomes smaller gradually toward the edge portions 13*b*2 and 13*b*3. Accordingly, at the first corner portion 8, it is possible to reduce the pressing force with respect to the first corner portion 8 and reduce the possibility that printing residue adheres to the thermal head X1 since the first corner portion 8 is disposed at the position at which the inclination angle θ1 from the substrate 7 is 75° or less.

In addition, there is a possibility that the recording medium is scraped off by the corner portion when the recording medium comes into contact with the first corner portion 8 and printing residue is generated, but it is possible to reduce the possibility that the first corner portion 8 and the recording medium come into contact by providing the first corner portion 8 at the position at which the inclination angle θ1 from the substrate 7 is 75° or less.

In addition, it is preferable that the inclination angle θ1 from the substrate 7 is 75° or less, and is 35° or more. Thereby, it is possible to suppress the first corner portion 8 from too coming close to the edge portion 13*b*3 of the ridge portion 13*b*. As a result, it is possible to secure a distance to the edge portion 13*b*3 of the ridge portion 13*b* in which precision of exposure falls, and it is possible to form a fine electrode pattern.

It is preferable that the inclination angle θ1 from the substrate 7 is 60° or less, and is 40° or more. Thereby, it is possible to form the fine electrode pattern while reducing the possibility that printing residue is accumulated at the first corner portion 8.

At least a part of the first individual electrode 19*a* which is adjacent to the common electrode 17 has the second corner portion 10 which faces the first corner portion 8, and the second corner portion 10 is disposed more upstream in the conveyance direction S than the first corner portion 8. Therefore, viewed from the upstream side in the conveyance direction S, it is possible to dispose the second corner portion 10 so as to conceal a part of the first corner portion 8, and reduce the possibility that printing residue is accumulated at the first corner portion 8.

That is, the ridge portion of the wide portion 4 is disposed so as to fill the gap 12, and when viewing the upstream side in the conveyance direction from the first corner portion 8, the second corner portion 10 and the wide portion 4 are formed. Accordingly, it is possible to reduce the possibility that printing residue enters the gap 12. As a result, it is possible to reduce the possibility that printing residue is accumulated at the first corner portion 8.

In addition, it is preferable that in the conveyance direction S, the second corner portion 10 is disposed so as to face the first corner portion 8, and it is preferable that in the conveyance direction S, a region where the first corner portion 8 and the second corner portion 10 face is 50% or more of the width of the first corner portion 8. Accordingly, it is possible to reduce the possibility that printing residue enters the gap 12.

In addition, the second corner portion 10 is disposed adjacent to the first corner portion 8 in the conveyance direction S when viewed in a plan view. Thereby, it is possible to disperse the pressing force generated at the first corner portion 8 by the second corner portion 10, and it is possible to reduce the pressing force generated at the first corner portion 8. As a result, it is possible to reduce the possibility that printing residue is accumulated at the first corner portion 8.

The second corner portion 10 is disposed at a position where an inclination angle θ2, from the substrate 7, of an imaginary line i3 which connects the intersection point C and the second corner portion 10 is 75° or less. Accordingly, the second corner portion 10 is disposed on the edge portion 13*b*3 side, and it is possible to reduce the possibility that the protection layer 25 and the covering layer 27 which are disposed on the second corner portion 10 interfere with the conveyance of the recording medium.

The third corner portion 14 is disposed more downstream in the conveyance direction S than the first corner portion 8 and the second corner portion 10, is disposed more upstream in the conveyance direction S than the top portion 13*b*1, and is formed so as to be lowered downward. Accordingly, it is possible to reduce a contact area between the recording medium and the thermal head X1 by an occupied area of the third corner portion 14. Thereby, it is possible to reduce the possibility that sticking is generated.

In addition, the common electrode 17 has the first corner portion 8, and the first corner portion 8 is formed by the narrow portion 6. Accordingly, it is possible to form the wide portion 4 of the individual electrode 19 in the gap 12 which is generated by the narrow portion 6. Thereby, the width of the wide portion 4 of the first individual electrode 19*a*, the width of the narrow portion 6 of the common electrode 17, and the width of the wide portion 4 of the second individual electrode 19*b* can be substantially equal lengths.

Note that, in a cross section in a sub-scanning direction, the imaginary line i2 which connects the intersection point C and the first corner portion 8 is a line segment which connects the first corner portion 8 and the intersection point C. In addition, in a cross section in the sub-scanning direction, the imaginary line i3 which connects the intersection point C and the second corner portion 10 is a line segment which connects the second corner portion 10 and the intersection point C. Accordingly, it is possible to measure the inclination angles θ1 and θ2 by capturing a cross-sectional image in the sub-scanning direction, and depicting the imaginary lines i1, i2, and i3.

The protection layer 25 covers the first heat generating portion 9*a*, the second heat generating portion 9*b*, the third heat generating portion 9*c*, the fourth heat generating portion 9*d*, the folded electrode 18, a part of the common electrode 17, and a part of the individual electrode 19. Then, the protection layer 25 is disposed on the first corner portion 8 and the second corner portion 10.

Accordingly, the protection layer 25 is configured to enter the gap 12 between the first corner portion 8 and the second corner portion 10, it is possible to increase adhesiveness of the protection layer 25, the common electrode 17, and the individual electrode 19, and it is possible to reduce the possibility of separation of the protection layer 25.

In addition, the first corner portion 8 and the second corner portion 10 are disposed on the ridge portion 13*b*, and are disposed between the top portion 13*b*1 and the edge portion 13*b*3. Then, since the protection layer 25 is disposed on the first corner portion 8 and the second corner portion 10, even in a case where pressing force which is high on the first corner portion 8 and the second corner portion 10 is generated, since adhesiveness of the protection layer 25, the common electrode 17, and the individual electrode 19 is high, it is possible to reduce the possibility of separation of the protection layer 25.

In particular, the thermal head X1 which is subjected to a polishing process in order to smoothen the surface of the protection layer 25 is preferable since it is possible to reduce the possibility of separation of the protection layer 25. Accordingly, it is preferable to form the first corner portion 8 and the second corner portion 10 in the region which is subjected to the polishing process.

In addition, the covering layer 27 is disposed on the protection layer 25, and the covering layer 27 is disposed on the first corner portion 8 and the second corner portion 10. Accordingly, the protection layer 25 and the covering layer 27 are disposed in this order on the first corner portion 8 and the second corner portion 10.

Thereby, even in a case where stepped portions are generated on the surface of the protection layer 25 by the first corner portion 8 and the second corner portion 10, it is possible to embed a stepped portion on the surface of the protection layer 25 using the covering layer 27. As a result, it is possible to eliminate any stepped portion on the surface of the protection layer 25 which is generated by the first corner portion 8 and the second corner portion 10, and it is possible to reduce the possibility that printing residue adheres to the thermal head 3*b*3.

Figure 6:
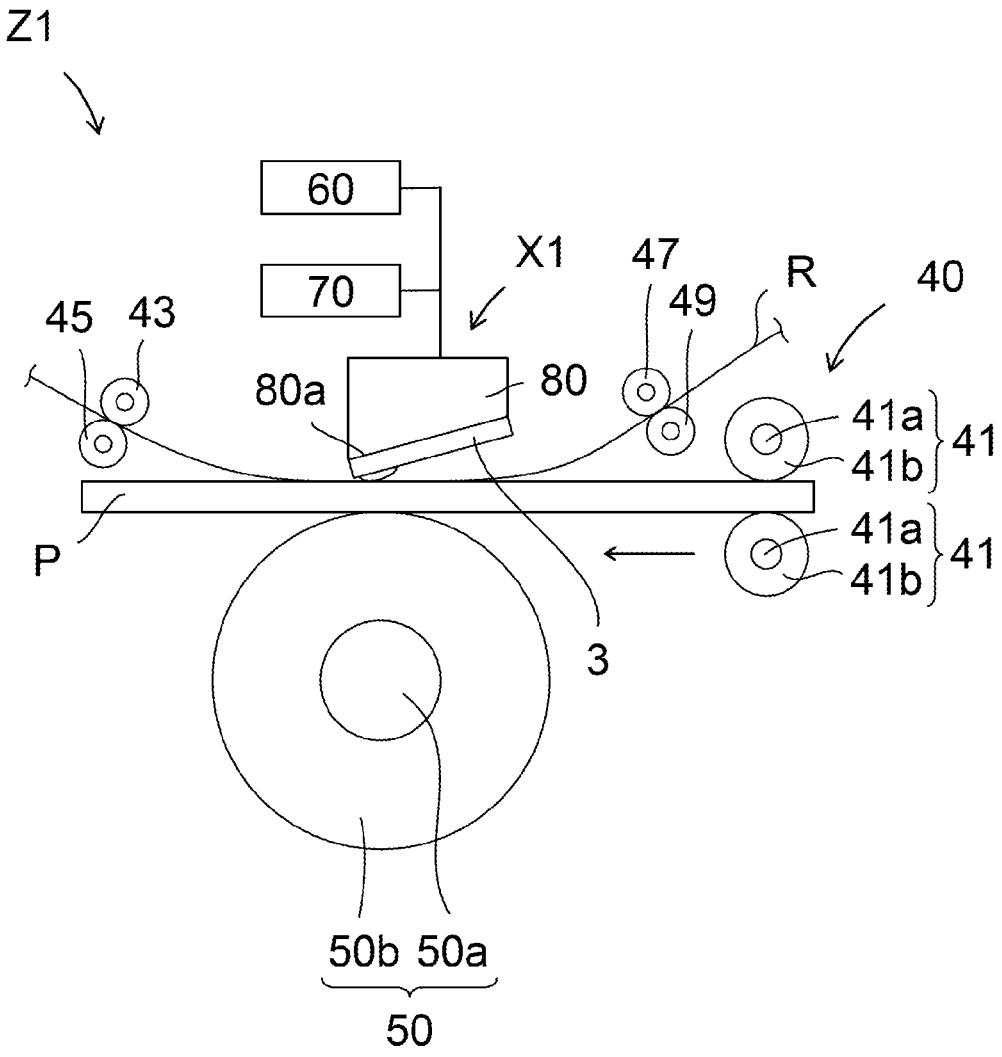
FIG. 6 is a schematic view illustrating a thermal printer according to the first embodiment of the invention.

Subsequently, a thermal printer Z1 is described with reference to FIG. 6. The thermal printer Z1 shown in FIG. 6 is schematically indicated, in practice, a platen roller 50 is much larger than the thermal head 3*b*3, and the contact state of the thermal head 3*b*3 and the recording medium is different from the state shown in FIG. 6.

The thermal printer Z1 of the present embodiment includes the thermal head 3*b*3, a conveying mechanism 40, a platen roller 50, a power source device 60, and a control device 70. The thermal head 3*b*3 is attached to an attachment surface 80*a* of an attachment member 80 that is disposed in a housing (not illustrated) of the thermal printer Z1.

The conveying mechanism 40 has a driving portion (not illustrated) and conveying rollers 43, 45, 47, and 49. The conveying mechanism 40 conveys the recording medium P such as image receiving paper onto which ink is to be transferred in the conveyance direction S, and conveys the recording medium P on the protection layer 25 which is positioned on the plurality of heat generating portions 9 of the thermal head 3*b*3.

The recording medium P includes image receiving paper onto which ink is to be transferred and an ink ribbon R onto which ink is applied, and indicates printing by the thermal head 3*b*3. Note that, in a case where heat sensitive paper is used as the recording medium, the ink ribbon R is unnecessary.

The driving portion has a function of driving the conveying rollers 43, 45, 47, and 49, and for example, a motor can be used. For example, the conveying rollers 43, 45, 47, and 49 can be configured to cover a cylindrical shaft body (not illustrated) made of metal such as stainless steel with an elastic member (not illustrated) made of butadiene rubber or the like.

The platen roller 50 has a function of pressing the recording medium P against the protection layer 25 which is positioned on the heat generating portion 9 of the thermal head 3*b*3. The platen roller 50 is disposed so as to extend along a direction orthogonal to the conveyance direction S, and both end portions there of are supported so as to be rotatable in a state where the recording medium P is pressed against the heat generating portion 9. For example, the platen roller 50 can be configured to cover a cylindrical shaft body 50*a* made of metal such as stainless steel with an elastic member 50*b* made of butadiene rubber or the like.

The power source device 60 has a function of supplying a current for generating heat in the heat generating portion 9 of the thermal head 3*b*3 as described above and a current for operating the driving IC 11. The control device 70 has a function of supplying a control signal which controls the operation of the driving IC 11 to the driving IC 11 in order to selectively generate heat in the heat generating portion 9 of the thermal head 3*b*3 as described above.

The thermal printer Z1 performs predetermined printing on the recording medium P by selectively generating heat in the heat generating portion 9 by the power source device 60 and the control device 70 while pressing the recording medium P against the heat generating portion 9 of the thermal head 3*b*3 by the platen roller 50 and conveying the recording medium P on the heat generating portion 9 by the conveying mechanism 40.

Second Embodiment

Figure 7:
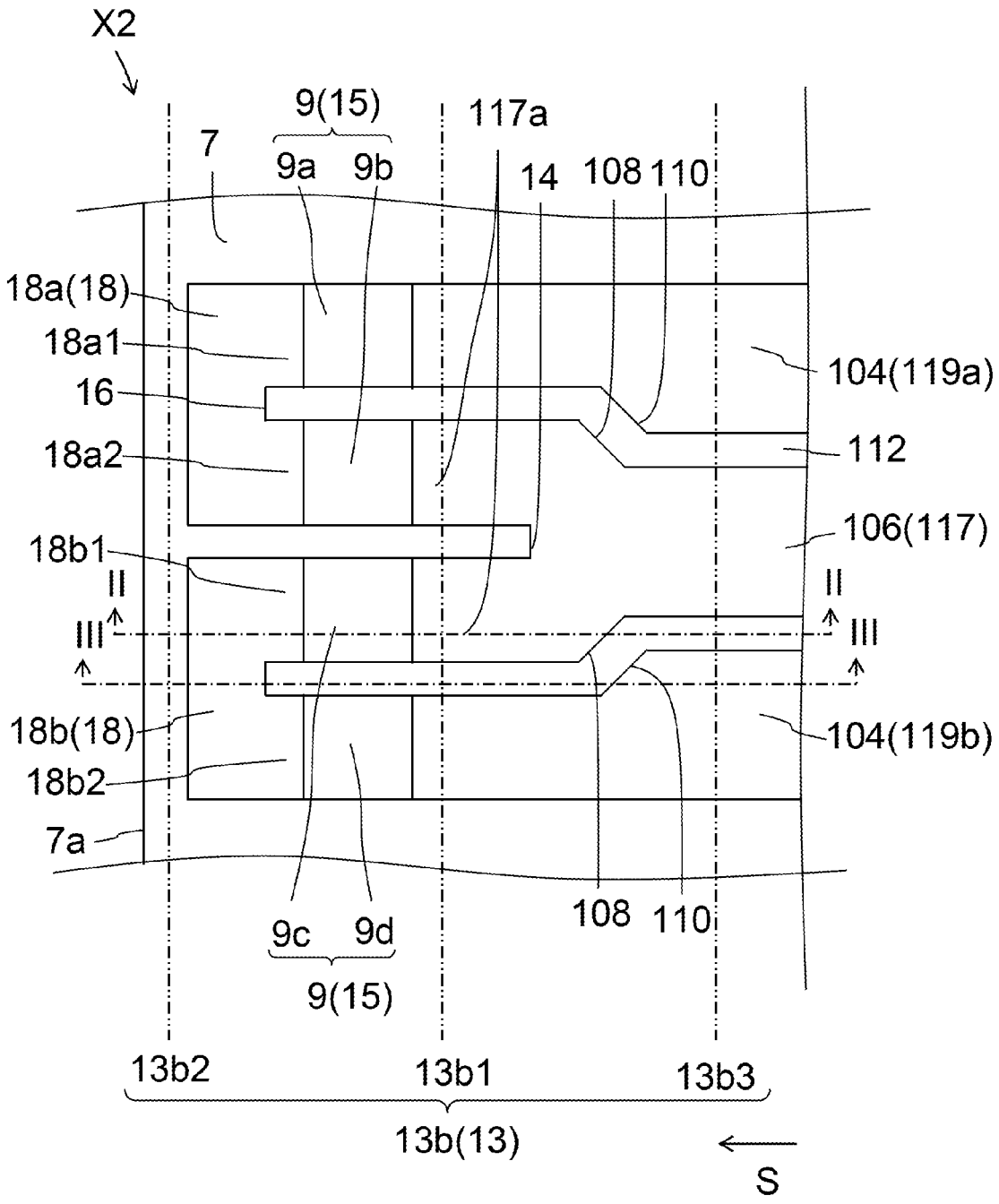
FIG. 7 is an enlarged plan view illustrating a vicinity of a heat generating portion of a thermal head according to a second embodiment of the invention.

A thermal head X2 according to a second embodiment is described with reference to FIG. 7. The thermal head X2 is different from the thermal head 3*b*3 in the configuration of a first individual electrode 119*a*, a common electrode 117, and a second individual electrode 119*b*. Other members are the same, and the same reference numerals are given.

The first individual electrode 119*a* and the second individual electrode 119*b* each have a wide portion 104 which protrudes toward the common electrode 117. The wide portion 104 is disposed so that a side surface thereof faces the conveyance direction S, and a second corner portion 110 is formed so that the side surface extends downward. The side surface of the wide portion 104 is disposed so as to be inclined to have a predetermined angle without being orthogonal to the conveyance direction S.

The common electrode 117 has a connecting portion 117*a* which is connected to the second heat generating portion 9*b*, a connecting portion 117*a* which is connected to the third heat generating portion 9*c*, and a narrow portion 106. The narrow portion 106 connects the connecting portion 117*a* which is connected to the second heat generating portion 9*b* and the connecting portion 117*a* which is connected to the third heat generating portion 9*c*, and a width thereof is smaller than a length of the width of the total of the connecting portion 117*a* which is connected to the second heat generating portion 9*b* and the connecting portion 117*a* which is connected to the third heat generating portion 9*c*.

The narrow portion 106 is disposed so that the side surface thereof faces the conveyance direction S, and a first corner portion 108 is formed so that the side surface thereof protrudes upward. The side surface of the narrow portion 106 is disposed so as to be inclined to have a predetermined angle without being orthogonal to the conveyance direction S.

Accordingly, even in a case where printing residue enters a gap 112 of the thermal head X2, printing residue is conveyed inside the gap 112 with conveyance of the recording medium (not illustrated), and printing residue is released to the outside of the gap 112 along the first corner portion 108. As a result, it is possible to suppress printing residue from being accumulated at the first corner portion 108.

In addition, it is preferable that the inclination angle with respect to the conveyance direction S of the first corner portion 108 and the inclination angle with respect to the conveyance direction S of the second corner portion 110 are substantially equal in a plan view. In other words, it is preferable that the first corner portion 108 and the second corner portion 110 are substantially parallel in a plan view. Thereby, it is possible to set a constant interval of the gap 112 in the conveyance direction S, and it is possible to make an area of the exposed thermal storage layer 13 close to uniform in the conveyance direction S. As a result, it is possible to reduce variance of temperature distribution of the thermal head X2.

Third Embodiment

Figure 8:
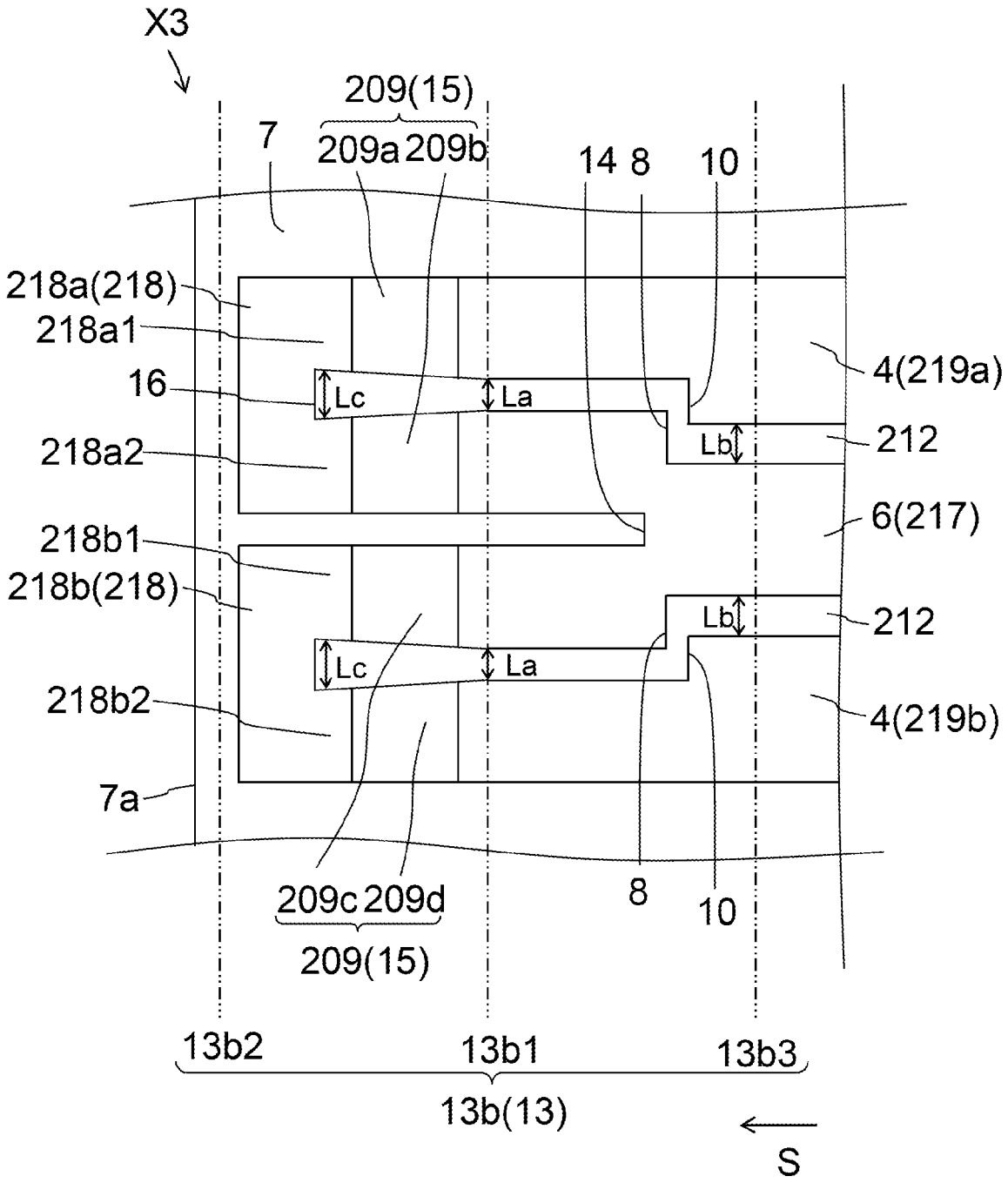
FIG. 8 is an enlarged plan view illustrating a vicinity of a heat generating portion of a thermal head according to a third embodiment of the invention.

A thermal head X3 according to a third embodiment is described with reference to FIG. 8.

The thermal head X3 is different from the thermal head X1 in the shape of a heat generating portion 209, a folded electrode 218, an individual electrode 219, and a common electrode 217. In the thermal head X3, the heat generating portion 209 has a trapezoidal shape. Then, in a plan view, side surfaces of the folded electrode 218, the individual electrode 219, and the common electrode 217 in the vicinity of the heat generating portion 209 is inclined with respect to the conveyance direction S.

A gap La between the individual electrode 219 and the common electrode 217 which are adjacent to each other and are positioned on the top portion 13*b*1 is smaller than a gap Lb between the individual electrode 219 and the common electrode 217 which are adjacent to each other and are positioned more upstream in the conveyance direction S than the top portion 13*b*1.

Thereby, in a configuration of the top portion 13*b*1 in which the pressing force of the platen roller (not illustrated) is great, printing residue does not tend to enter the gap 212. As a result, it is possible to reduce the possibility that printing residue is retained close to the heat generating portion 209.

It is preferable that the gap La is 1.02 to 1.3 times the gap Lb. Thereby, it is possible to reduce the possibility that printing residue is retained close to the heat generating portion 209.

In addition, a gap Lc between a first connecting portion 218*a*1 which is connected to the first heat generating portion 209*a* of a first folded electrode 218*a* and a second connecting portion 218*a*2 which is connected to the second heat generating portion 209*b* of the first folded electrode 218*a* is wider than the gap La on the top portion 13*b*1 between the first individual electrode 219*a* and the common electrode 217 which are adjacent to each other. Accordingly, viewed from the upstream side in the conveyance direction S, the width of the gap 212 is increased.

Thereby, even in a case where printing residue enters the gap 212 between the first individual electrode 219*a* and the common electrode 217 which are adjacent to each other and are positioned on the top portion 13*b*1, in the conveyance direction S, the gap 212 increases and therefore it is possible to release printing residue which enters the gap 212 to the outside.

It is preferable that a gap Lc is 1.02 to 1.03 times the gap La. Thereby, it is possible to release printing residue which enters the gap 212 to the outside.

Fourth Embodiment

Figure 9:
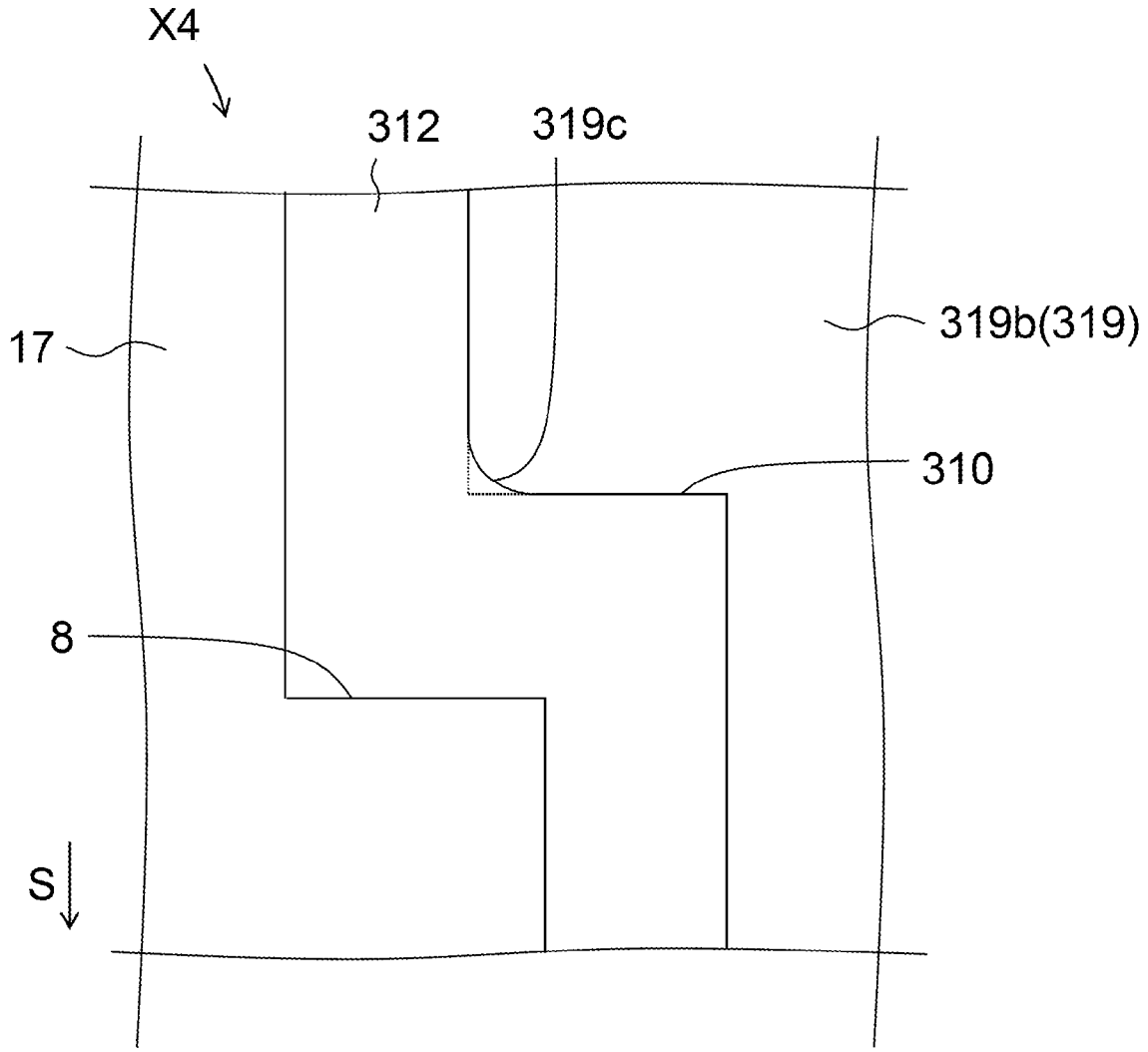
FIG. 9 is an enlarged plan view illustrating a vicinity of a first corner portion of a thermal head according to a fourth embodiment of the invention.

A thermal head X4 according to a fourth embodiment is described with reference to FIG. 9. Note that, FIG. 9 illustrates enlargement of the vicinity of the first corner portion 8 and the second corner portion 310.

The common electrode 17 has a bent portion in a plan view, and has the first corner portion 8 in the bent portion. a second individual electrode 319*b* which is adjacent to the common electrode 17 has a curved portion 319*c* in a plan view, and has the second corner portion 10 in the curved portion 319*c*. Note that, a shape of the second individual electrode 319*b* in a case where the second corner portion 310 is not curved is indicated by a broken line.

When the first corner portion 8 is provided on the bent portion of the common electrode 17 and the second corner portion 310 is provided on the curved portion 319*c* of the second individual electrode 319*b*, it is possible to increase an area of a gap 312 which is formed by the first corner portion 8 and the second corner portion 310.

That is, by curving the second corner portion 310, it is possible to increase an area of the gap 312 in the vicinity of the first corner portion 8 and the second corner portion 310 in comparison to a case of bending as shown by a broken line. Accordingly, it is possible to reduce the possibility of printing residue being jammed in the gap 312 in the vicinity of the first corner portion 8 and the second corner portion 310.

In addition, when the first corner portion 8 is provided in the bent portion, it is possible to reduce resistance with respect to flow of printing residue that is generated by the side surface facing the conveyance direction S of the common electrode 17. Thereby, it is possible to release printing residue that is accumulated in the first corner portion 8 to the outside.

Fifth Embodiment

Figure 10:
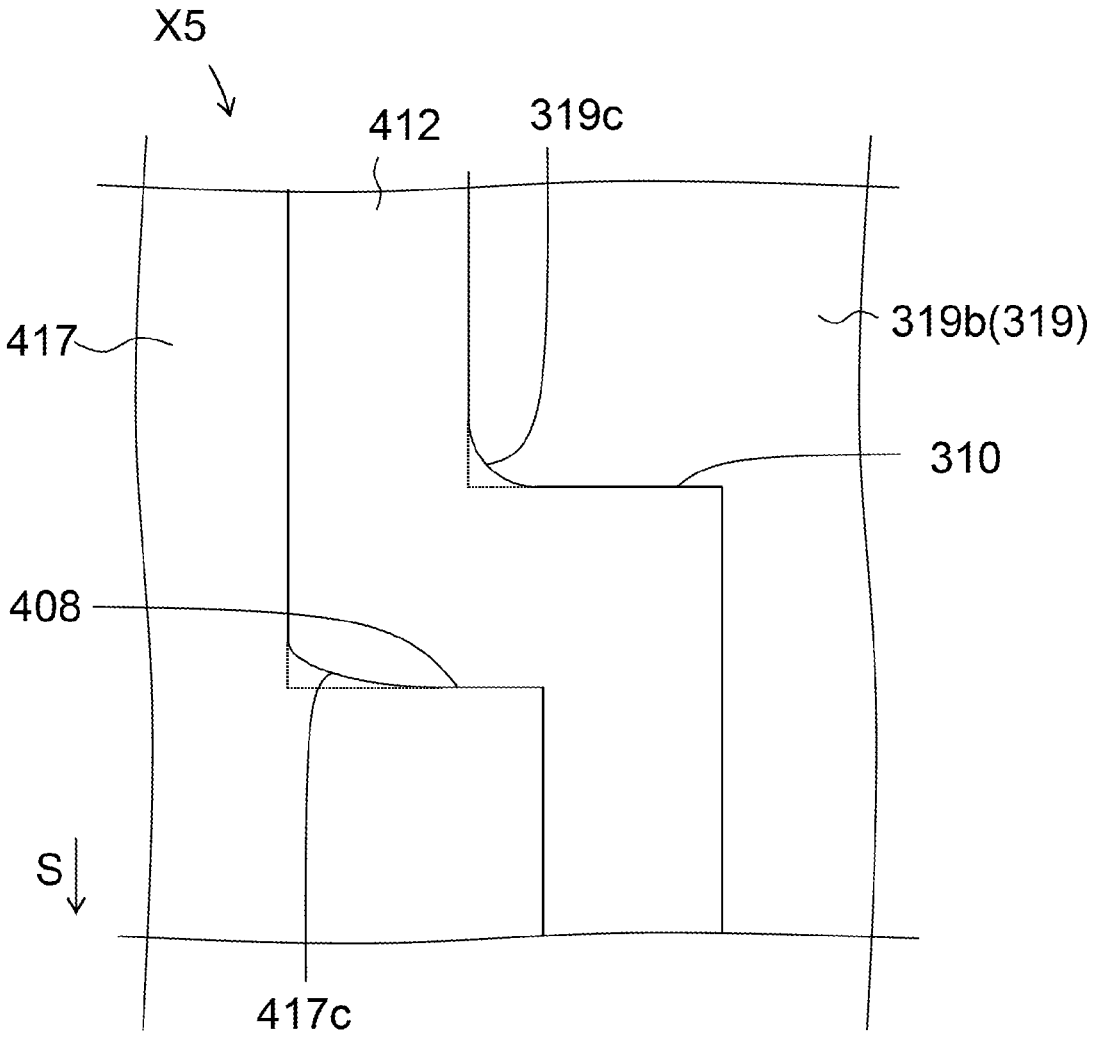
FIG. 10 is an enlarged plan view illustrating a vicinity of a first corner portion of a thermal head according to a fifth embodiment of the invention.

A thermal head X5 according to a fifth embodiment is described with reference to FIG. 10.

The common electrode has a first curved portion 417*c* in a plan view, and has a first corner portion 408 in the first curved portion 417*c*, and a second individual electrode 319*b* which is adjacent to the common electrode 417 has a second curved portion 319*c* in a plan view, and has the second corner portion 310 in the second curved portion 319*c*. Then, curvature of the first curved portion 417*c* is smaller than curvature of the second curved portion 319*c*. Note that, a shape where the first corner portion 408 and the second corner portion 310 are not curved are indicated by a broken line.

By having the first curved portion 417*c* and the second curved portion 319*c*, It is possible to increase an area of a gap 412 which is formed by the first corner portion 408 and the second corner portion 310.

That is, by having the first curved portion 417*c* and the second curved portion 319*c*, it is possible to increase an area in the vicinity of the first corner portion 408 and the second corner portion 310 in comparison to a case of being bent as shown by a broken line. Accordingly, it is possible to reduce the possibility that printing residue is jammed in the gap 412 in the vicinity of the first corner portion 408 and the second corner portion 310.

In addition, since the curvature of the first curved portion 417*c* is smaller than the curvature of the second curved portion 319*c*, it is possible to increase an area in the vicinity of the first corner portion 408 and the second corner portion 310 while reducing resistance to flow of printing residue generated by a side surface facing the conveyance direction S of the common electrode 17. Thereby, it is possible to release printing residue which is accumulated in the first corner portion 408 to the outside.

Embodiments of the invention are described above, but the invention is not limited to the embodiments described above, and various modifications are possible without departing from the scope of the invention. For example, the thermal printer Z1 which employs the thermal head 3*b*3 according to the first embodiment is illustrated, but the invention is not limited thereto, and the thermal heads X2 to X5 may be employed in the thermal printer Z1. In addition, the thermal heads 3*b*3 to X5 which are a plurality of embodiments may be combined.

In addition, as the thermal heads 3*b*3 to X3, a thermal head with a folded structure which is connected to the adjacent heat generating portions 9 via the folded electrode 18 is exemplified, but the invention is not limited thereto. A thermal head may be of a flat type that has the common electrode 17 which extends from one short side 7*c* of the substrate 7 to the other short side 7*d* between the heat generating portion 9 and one long side 7*a*, or may be of an end surface type on which the heat generating portion 9 is disposed on an end surface of the substrate 7.

REFERENCE SIGNS LIST

X1 to X5: Thermal head
Z1: Thermal printer
1: Heat dissipation body
3: Head base
4: Wide portion
5: Flexible printed circuit board
6: Narrow portion
7: Substrate
8: First corner portion
9: Heat generating portion
10: Second corner portion
11: Driving IC
12: Gap
13: Thermal storage layer
13*b*: Ridge portion
14: Third corner portion
15: Electrical resistance layer
17: Common electrode
18: Folded electrode
19: Individual electrode
21: Connection electrode
23: Joining material
25: Protection layer
27: Covering layer
29: Covering member
i1: First imaginary line
i2: Second imaginary line
i3: Third imaginary line

The invention claimed is:

1. A thermal head, comprising:
a substrate;
a thermal storage layer disposed on the substrate, the thermal storage layer having a ridge portion which protrudes upward from the substrate;
a plurality of heat generating portions disposed on the ridge portion; and
a plurality of electrodes which are disposed on the substrate and electrically connected to the plurality of heat generating portions,
the plurality of heat generating portions being disposed more downstream in a conveyance direction of a recording medium than a top portion of the ridge portion,
at least one of the electrodes having an upper surface, a side surface facing the conveyance direction, and a first corner portion at which the side surface and the upper surface intersect, more upstream in the conveyance direction than the top portion,
wherein a gap between electrodes which are adjacent to each other and are positioned on the top portion is smaller than a gap between electrodes which are adjacent to each other and are positioned on the ridge portion more upstream in the conveyance direction than the top portion.

2. The thermal head according to claim 1, wherein an electrode adjacent to the electrode having the first corner portion has a second corner portion at least part of which faces the first corner portion, and the second corner portion is disposed more upstream in the conveyance direction than the first corner portion.

3. The thermal head according to claim 1, wherein the plurality of heat generating portions include a first heat generating portion, a second heat generating portion, a third heat generating portion, and a fourth heat generating portion which are disposed so as to be adjacent to one another in a main scanning direction, the electrodes includes:
a first folded electrode connected to one side of the first heat generating portion and one side of the second heat generating portion;
a second folded electrode connected to one side of the third heat generating portion and one side of the fourth heat generating portion;
a first individual electrode connected to the other side of the first heat generating portion;
a common electrode connected to the other side of the second heat generating portion and the other side of the third heat generating portion; and
a second individual electrode connected to the other side of the fourth heat generating portion, and
the common electrode has the first corner portion.

4. The thermal head according to claim 3, wherein the first folded electrode includes a first connecting portion which is connected to the first heat generating portion and a second connecting portion which is connected to the second heat generating portion, and a gap between the first connecting portion and the second connecting portion is wider than a gap on the top portion between the first individual electrode and the common electrode.

5. The thermal head according to claim 3, wherein the common electrode has a bent portion in a plan view thereof, and has the first corner portion on the bent portion, at least one of the first individual electrode and the second individual electrode has a second corner portion at least part of which faces the first corner portion, and at least one of the first individual electrode and the second individual electrode has a curved portion in a plan view thereof, and has the second corner portion in the curved portion.

6. The thermal head according to claim 3, wherein the common electrode has a first curved portion in a plan view thereof, and has the first corner portion on the first curved portion, at least one of the first individual electrode and the second individual electrode has a second corner portion at least part of which faces the first corner portion, and at least one of the first individual electrode and the second individual electrode has a second curved portion in a plan view thereof, has a the second corner portion on the second curved portion, and curvature of the first curved portion is smaller than curvature of the second curved portion.

7. The thermal head according to claim 3, further comprising:
a protection layer disposed on the first heat generating portion, the second heat generating portion, and the third heat generating portion,
wherein at least one of the first individual electrode and the second individual electrode has a second corner portion at least part of which faces the first corner portion, and
the protection layer is disposed on the first corner portion and the second corner portion.

8. The thermal head according to claim 7, further comprising:
a covering layer disposed on the protection layer, the covering layer being disposed on the first corner portion and the second corner portion.

9. A thermal printer, comprising:

the thermal head according to claim 1;

a conveying mechanism which conveys the recording medium on the heat generating portion; and a platen roller which presses the recording medium against the heat generating portion.

10. The thermal head according to claim 1, wherein in a cross section of the thermal head, an inclination angle of a first imaginary line which connects an intersection point of a second imaginary line which hangs downward from the top portion and the substrate, with the first corner portion, is 75° or less from the substrate.

11. The thermal head according to claim 10, wherein the inclination angle is between 35° and 75°, including 35° and 75°.

12. A thermal head, comprising:

a substrate;

a thermal storage layer disposed on the substrate, the thermal storage layer having a ridge portion which protrudes upward from the substrate;

a plurality of heat generating portions disposed on the ridge portion; and a plurality of electrodes which are disposed on the substrate and electrically connected to the plurality of heat generating portions, the plurality of heat generating portions being disposed more downstream in a conveyance direction of a recording medium than a top portion of the ridge portion, at least one of the electrodes having an upper surface, a side surface facing the conveyance direction, and a first corner portion at which the side surface and the upper surface intersect, more upstream in the conveyance direction than the top portion, wherein an electrode adjacent to the electrode having the first corner portion has a second corner portion at least part of which faces the first corner portion, and the second corner portion is disposed more upstream in the conveyance direction than the first corner portion.

13. The thermal head according to claim 12, wherein in a cross section of the thermal head, an inclination angle of a first imaginary line which connects an intersection point of a second imaginary line which hangs downward from the top portion and the substrate, with the first corner portion, is 75° or less from the substrate.

14. A thermal printer, comprising:

the thermal head according to claim 12;

a conveying mechanism which conveys the recording medium on the heat generating portion; and a platen roller which presses the recording medium against the heat generating portion.

15. A thermal head, comprising:

a substrate;

a thermal storage layer disposed on the substrate, the thermal storage layer having a ridge portion which protrudes upward from the substrate;

a plurality of heat generating portions disposed on the ridge portion; and a plurality of electrodes which are disposed on the substrate and electrically connected to the plurality of heat generating portions, the plurality of heat generating portions being disposed more downstream in a conveyance direction of a recording medium than a top portion of the ridge portion, at least one of the electrodes having an upper surface, a side surface facing the conveyance direction, and a first corner portion at which the side surface and the upper surface intersect, more upstream in the conveyance direction than the top portion, wherein the plurality of heat generating portions include a first heat generating portion, a second heat generating portion, a third heat generating portion, and a fourth heat generating portion which are disposed so as to be adjacent to one another in a main scanning direction, the electrodes includes:

a first folded electrode connected to one side of the first heat generating portion and one side of the second heat generating portion;

a second folded electrode connected to one side of the third heat generating portion and one side of the fourth heat generating portion;

a first individual electrode connected to the other side of the first heat generating portion;

a common electrode connected to the other side of the second heat generating portion and the other side of the third heat generating portion; and a second individual electrode connected to the other side of the fourth heat generating portion, and the common electrode has the first corner portion, the first folded electrode includes a first connecting portion which is connected to the first heat generating portion and a second connecting portion which is connected to the second heat generating portion, and a gap between the first connecting portion and the second connecting portion is wider than a gap on the top portion between the first individual electrode and the common electrode.

16. The thermal head according to claim 15, wherein in a cross section of the thermal head, an inclination angle of a first imaginary line which connects an intersection point of a second imaginary line which hangs downward from the top portion and the substrate, with the first corner portion, is 75° or less from the substrate.

17. A thermal printer, comprising:

the thermal head according to claim 15;

a conveying mechanism which conveys the recording medium on the heat generating portion; and a platen roller which presses the recording medium against the heat generating portion.

* * * * *